United States Patent [19]

Furuta et al.

[11] Patent Number: 5,037,552

[45] Date of Patent: Aug. 6, 1991

[54] PROCESS FOR REMOVAL OF MERCURY FROM A LIQUID HYDROCARBON

[75] Inventors: Akio Furuta; Kunio Sato; Kazuo Sato; Tooru Matsuzawa; Hirofumi Ito, all of Handa, Japan

[73] Assignee: JCG Corporation, Japan

[21] Appl. No.: 352,024

[22] Filed: May 15, 1989

[30] Foreign Application Priority Data

Jul. 25, 1988 [JP] Japan ..... 63-183559
Jan. 30, 1989 [JP] Japan ..... 1-17677

[51] Int. Cl.[5] ..... B01D 11/04
[52] U.S. Cl. ..... 210/634; 210/914
[58] Field of Search ..... 210/634, 670, 914, 688, 210/679; 55/74, 59; 208/253, 251 R, 305; 423/210

[56] References Cited

U.S. PATENT DOCUMENTS 4,474,896 10/1984 Chao ..... 55/74 X
4,877,515 10/1989 Audeh ..... 55/59 X
4,880,527 11/1989 Audeh ..... 208/251 R
4,915,818 4/1990 Yan ..... 208/251 R

*Primary Examiner*—Frank Spear
*Attorney, Agent, or Firm*—Cushman, Darby & Cushman

[57] ABSTRACT

A liquid hydrocarbon such as a natural gas liquid generally contains a small amount of mercury in a state of elemental mercury, ionized mercury, ionizable mercury compounds, which are requested to be removed thoroughly. Further, organic mercury compounds are contained in some natural gas liquid and other liquid hydrocarbons depending on their district of production, and its removal is also necessary.

Already known adsorbents can adsorb elemental mercury and organic mercury compounds in a liquid hydrocarbon, but they hardly adsorb ionizable mercury compounds and ionized mercury derived from the ionizable mercury compounds.

According to the preesent invention which comprises contacting the liquid hydrocarbon with a sulfur compound represented by a general formula $MM'S_x$, wherein M is selected from a group consisting of alkali metal and ammonium radical, M' is selected from a group consisting of alkali metal, ammonium radical and hydrogen an x is a number of at least 1, the sulfur compound and mercury in the liquid hydrocarbon reacts to form mercury sulfide which is insoluble in the liquid hydrocarbon to be separated therefrom.

If the liquid hydrocarbon contains organic mercury compounds together with elemental mercury ionized mercury and ionizable mercury compounds, the above-mentioned process is to be combined with a process of contacting the liquid hydrocarbon with an adsorbent comprising heavy metal sulfide to adsorb the organic mercury compounds together with the mercury sulfide which is formed in the above-mentioned process.

11 Claims, No Drawings

PROCESS FOR REMOVAL OF MERCURY FROM A LIQUID HYDROCARBON

FIELD OF THE INVENTION

The present invention relates to a process for removal of mercury from a liquid hydrocarbon containing mercury.

For example, a natural gas liquid (NGL), liquid hydrocarbons recovered from natural gas, contains mercury in amounts ranging from several ppb (parts per billion) to several thousands ppb depending on its district of production. The mercury causes an amalgamation corrosion of aluminum used for construction of equipments, and induces poisoning and deterioration of activity of catalysts when a natural gas liquid containing mercury is used as a raw material in a successive catalytic reaction process.

Mercury in a natural gas liquid generally exists in the forms of ionized mercury, ionizable mercury compounds and elemental mercury. All of them are requested to be removed. Further, organic mercury compounds are contained in some natural gas liquid depending on its district of production, and its removal is also necessary.

DESCRIPTION OF THE PRIOR ART

Heretofore, most of the processes for removal of mercury dealt with industrial sewages or exhaust gases of incinerators in general.

As for the natural gas, the following two methods appears to be proposed:

a) cooling condensation method, and b) adsorption (absorption) method.

The former method is employed in natural gas liquefaction plants. However, the method is not applicable for removal of mercury from a liquid hydrocarbon such as a natural gas, because the method includes cooling step using adiabatic expansion which is employable to gaseous material only.

The latter method uses various adsorbents; for example, an alumina or a zeolite impregnated with silver or an activated charcoal or a molecular sieve impregnated with potassium iodide or sulfur. There are, however, such problems in them as the expensiveness of the adsorbents, a small adsorption capacity and reduction of the mercury adsorbing capacity due to co-adsorption of liquid hydrocarbons.

Adsorbents composed of heavy metal sulfides were also proposed. U.S. Pat. No. 4,094,777 proposed a method for removal of mercury employing copper sulfide and U.S. Pat. 4,474,896 proposed polysulfide-containing adsorbent compositions for use in the adsorption of elemental mercury consisting essentially of a support; a cation selected from the group consisting of antimony, arsenic, bismuth,cadmium, cobalt, copper, gold, indium, iron, lead, manganese, molybdenum, mercury, nickel, platinum, silver, tin, tungsten, titanium, vanadium, zinc, zirconium and mixtures thereof; and a polysulfide.

The former method using copper sulfide is said to be able to remove mercury from gaseous or liquid hydrocarbons. However, its practical objective is a natural gas consisting mainly of methane containing negligible amount of liquid hydrocarbons having at 1 least five carbon atoms and around 19 $\mu g/m^3$ of mercury. The effectiveness of the method for liquid components containing a large amount of liquid hydrocarbons having mainly from 3 to 10 carbon atoms such as a natural gas liquid or a naphtha fraction, or for ones containing mercury in higher content is not clear.

As for the latter method using heavy metal polysulfide, adsorption of other type mercury than elemental mercury has not been mentioned.

The present inventors proposed a method which is characterized by contacting a gaseous or liquid hydrocarbon containing mercury with an adsorbent containing one or more sulfides of metals selected from a group consisting of molybdenum, tungsten and vanadium. (Japanese Patent Application Sho 62.286469; November 14, 1987)

The method removes elemental mercury and organic mercury compounds more efficiently in comparison with the prior arts.

However, as mentioned above, a natural gas liquid generally contains mercury in the forms of ionized mercury, ionizable mercury compounds and elemental mercury, and some natural gas liquid contains organic mercury compounds too.

In our experiment, it has become apparent that elemental mercury and organic mercury compounds can be adsorbed by the heavy metal sulfides well, but a little of ionized mercury or ionizable mercury compounds can be adsorbed by them.

Mercury ions existing in water may be removed, for example, by an activated charcoal or aluminum powder, but such adsorbent is not effective for removal of ionized mercury or ionizable mercury compounds in a liquid hydrocarbon.

SUMMARY OF THE INVENTION

It is a primary object of the present invention to provide a method for removal of ionized mercury and ionizable mercury compounds from a liquid hydrocarbon.

It is a further object of the present invention to provide a method for removal of mercury in various forms from a liquid hydrocarbon.

DETAILED DESCRIPTION OF THE PREFERRED EMBODIMENTS

The process for removal of mercury from a liquid hydrocarbon containing mercury according to the present invention comprises: contacting the liquid hydrocarbon with an aqueous solution of a sulfur compound represented by a general formula $MM'S_x$, wherein M is selected from a group consisting of alkali metal and ammonium radical, M' is selected from a group consisting of alkali metal, ammonium radical and hydrogen and x is a number of at least 1. This process is referred as "the reaction process" hereinafter.

The sulfur compound represented by the general formula $MM'S_x$ may react with either ionized mercury or ionizable mercury compounds in a liquid hydrocarbon to turn them to a solid material (mercury sulfide; HgS) which is insoluble in the liquid hydrocarbon.

Most of the solid material which is insoluble in the liquid hydrocarbon transfers to the aqueous phase and then can be separated from the liquid hydrocarbon.

The sulfur compound represented by the general formula $MM'S_x$ is a monosulfide when the figure x is 1. The representative monosulfides are $Na_2S$, NaHS, K2S, KHS, $(NH_4)2S$ and (NH4)HS, in which $Na_2S$ or $K_2S$ is most preferred. They are employed in a form of their aqueous solutions.

If a liquid hydrocarbon contains ionized mercury and ionizable mercury compounds mainly, the greater part of mercury contained in the liquid hydrocarbon can be removed by the above-mentioned reaction process.

However, though the monosulfides react with ionized mercury and ionizable mercury compounds and turn them to a solid material which is insoluble in liquid hydrocarbon, they do not react with elemental mercury. To remove elemental mercury, the reaction process using the monosulfide is recommended to be combined with a process of contacting the liquid hydrocarbon with an adsorbent which can adsorb elemental mercury.

In the sulfur compound represented by the general formula $MM'S_x$, when the figure x is 2 or more, at most 6 to 9 in many cases, they will be referred as polysulfides. Representative polysulfides are sodium polysulfide, potassium polysulfide, ammonium polysulfide and mixtures thereof. They are employed in a form of their aqueous solutions.

The polysulfides have a further advantage comparing to the above-mentioned monosulfides. Namely, the polysulfides react with elemental mercury too and turn it to a solid material which is insoluble in liquid hydrocarbon as shown in Example 16.

Accordingly, ionized mercury, ionizable mercury compounds and elemental mercury contained in a liquid hydrocarbon can be all turned to a solid material which is insoluble in the liquid hydrocarbon by contacting the liquid hydrocarbon with an reagent containing the abovementioned polysulfides.

As to the amount of the sulfur compound required for removal of mercury from a liquid hydrocarbon, it may be sufficient to give just the amount of S which corresponds to 10 times of the equivalent value to convert Hg to HgS. The treatment time may take for several seconds to several tens minutes, usually for 1-20 minutes under normal temperature and pressure.

However, it has been found that when a high concentration aqueous solution of the monosulfide or the polysulfide is used in the reaction process, the solid material which is insoluble in liquid hydrocarbon dissolves in the aqueous phase and can readily be separated from the liquid hydrocarbon phase. Further, a higher concentration aqueous solution of the monosulfide or the polysulfide can treat a lot of liquid hydrocarbons containing mercury.

Accordingly, the concentration of the monosulfide or the polysulfide in the aqueous solution is recommended to be more than 1 wt.% (weight percent), preferably more than 3 wt.%.

The contact of a liquid hydrocarbon containing mercury and the aqueous solution of a sulfur compound can be conducted using any of conventional liquid contacting method.

When organic mercury compounds has been contained in a liquid hydrocarbon depending on its district of production, the organic mercury compounds cannot be removed by contacting the liquid hydrocarbon with the sulfur compound represented by the general formula $MM'S_x$.

If a liquid hydrocarbon contains organic mercury compounds together with ionized mercury, ionizable mercury compounds and elemental mercury, the above-mentioned reaction process is recommended to be combined with a process of contacting the liquid hydrocarbon with an adsorbent which can adsorb organic mercury compounds.

As the adsorbent which can adsorb organic mercury compounds, a material comprising a heavy metal sulfide is the most preferable.

It has been found that the heavy metal sulfide not only adsorbs the organic mercury compounds and elemental mercury but also adsorbs effectively the solid material (HgS) which has been formed by the reaction of ionized mercury and ionizable mercury compounds with the sulfur compound represented by the general formula $MM'S_x$.

The process of contacting a liquid hydrocarbon with the adsorbent containing a heavy metal sulfide is referred as "the adsorption process" hereinafter.

The representative heavy metal sulfides are sulfides of molybdenum, tungsten, vanadium, copper, and their mixtures.

The heavy metal sulfide can be used by itself, but it is recommended to use it in a from of being supported on a carrier.

As the carrier, such particle material comprising silica, alumina, silica-alumina, zeolite, ceramics, glass, resins and an activated charcoal, etc. can be employed; among which alumina is most preferred.

The carrier is preferably selected from material with a large specific surface of 5.400 m2/g, preferably of 100.250 $m^2/g$, for giving a better contacting efficacy, though these are not critical.

When the heavy metal sulfide is supported on a carrier, the preferable amount of the heavy metal sulfide on the carrier is 1-15 wt.% as a metal. The adsorbent may contain other metallic or inorganic components.

The adsorbent may be prepared by sulfurization of molybdenum compound, tungsten compound or vanadium compound as it is or in a state supported on a carrier.

The latter may be prepared, for example, in such a way that an aqueous solution of molybdenum compound is impregnated in a carrier like alumina or a molybdenum compound is blended with a material for carrier and then molded into particles, and followed by calcining at 450-500° C. for 0.1 2 hours and sulfurized finally.

As a preferable molybdenum source, ammonium paramolybdate $[(NH_4)_6Mo_7O_{24}4H_2O]$; as a tungsten source, ammonium tungstate $[5(NH_4)_2O{\cdot}12WO3.5H_2O]$; and as a vanadium source, ammonium vanadate $[NH_4VO_3]$ are mentioned.

The sulfurization of the adsorbent can be conducted by using a mixture of hydrogen and hydrogen sulfide, in which hydrogen sulfide is contained preferably 0.1-10 volume %. The treatment temperature is 200-450° C., preferably 300-400° C.

The contact of a liquid hydrocarbon containing mercury with the adsorbent is preferably conducted at temperatures below 200° C. Temperatures above 200° C. may release mercury from the adsorbent or may cause problems such as evaporation or cracking of the liquid hydrocarbon.

Though the contact of a liquid hydrocarbon containing mercury and the adsorbent can be conducted using arbitrary methods, a fixed bed flowing method which enables a continuous operation is preferable.

The reaction process and the adsorption process may be conducted simultaneously or in succession. In the successive conduction, the order of the processes may be set optionally. However, in order to separate the solid material (HgS) which has been formed by the reaction process from the treated liquid hydrocarbon effectively, it is recommended that the adsorption process is conducted after the reaction process.

If the adsorption process is conducted after the separation of the water phase dissolving the solid material of mercury sulfide, the adsorbing capacity of adsorbents is only consumed by the adsorption of organic mercury compounds and remained elemental mercury, and the adsorbents can be used for a longer time.

The present invention can be most preferably adopted for removal of mercury from liquid hydrocarbons, for example, a natural gas liquid recovered from natural gas or liquid hydrocarbons obtained by liquefaction of gases produced as a by-product of petroleum.

The present invention will be illustrated hereunder in more detail by references and examples.

Reference A

In order to examine the types of mercury which can be removed by contacting a hydrocarbon containing mercury with a sulfur compound represented by a general formula $MM'S_x$, wherein M is selected from a group consisting of alkali metal and ammonium radical, M' is selected from a group consisting of alkali metal, ammonium radical and hydrogen and x is a number of at least 1, model liquids were prepared by dissolving in light naphtha each of elemental mercury, mercury chloride and diethylmercury so as to give a mercury content of 300 ppb (as Hg) respectively.

To 100 ml (milliliter) of each model liquids 100 ml of 5 wt.% aqueous solution of $Na_2S_4$ were added, and the mixture was shaken with a shaking apparatus. After 10 minutes of the shaking, liquid hydrocarbon phase and water phase were separated, and mercury content in the liquid hydrocarbon phase was measured.

The model liquid containing mercury chloride and the model liquid containing elemental mercury showed that almost all of the mercury were removed from it. However, the model liquid containing diethylmercury showed that a little of mercury was removed from it.

According to the results, it is found that the types of mercury which can be removed by contact with the sulfur compound represented by a general $MM'S_x$ are ionizable mercury compounds, ionized mercury derived from the ionizable mercury compounds and elemental mercury.

Example 1

100 ml of a natural gas liquid produced in Indonesia containing 350 ppb of mercury (as total Hg) and 100 ml of 5 wt.% sodium sulfide [$Na_2S$]aqueous solution were charged into a separating funnel to be shaken for 10 minutes. Then the water layer and the liquid hydrocarbon layer were separated, and the content of mercury in the liquid hydrocarbon layer was measured which showed a decreased value of 60 ppb.

In view of the Reference A, it is supposed that the natural gas liquid produced in Indonesia used in this example contains ionizable mercury compounds and ionized mercury mainly.

Example 2

100 ml of the same natural gas liquid as used in Example 1 and 100 ml of 5 wt.% potassium sulfide [$K_2S$]aqueous solution were charged into a separating funnel to be shaken for 10 minutes. Then the water layer and the liquid hydrocarbon layer were separated, and the content of mercury in the liquid hydrocarbon layer was measured which showed a decreased value of 63 ppb.

Example 3

100 ml of the same natural gas liquid as used in Example 1 and 100 ml of 5 wt.% ammonium sulfide [$(NH_4)_2S$]aqueous solution were charged into a separating funnel to be shaken for 10 minutes. Then the water layer and the liquid hydrocarbon layer were separated, and the content of mercury in the liquid hydrocarbon layer was measured which showed a decreased value of 72 ppb.

Example 4

100 ml of the same natural gas liquid as used in Example 1 and 100 ml of 5 wt.% sodium sulfide [Na2S]aqueous solution were charged into a separating funnel to be shaken for 10 minutes. Then the water layer and the liquid hydrocarbon layer were separated.

To 100 ml of the separated liquid hydrocarbon was added 0.1 gram of an adsorbent comprising Mo-sulfide/$\gamma$-$Al_2O_3$ containing 7 wt.% of molybdenum. The mixture was poured into a capped glass vessel and was shaken softly with a shaking apparatus for 10 minutes. Thereafter, the content of mercury in the liquid hydrocarbon layer was measured, whereby a value of below 1 ppb was observed.

Comparative Example 1

Into 200 ml of a natural gas liquid produced in Indonesia containing 350 ppb of mercury (as total Hg) was blown a gas containing 2 volume % of $H_2S$ (balance $H_2$) for 10 minutes. Then the liquid was allowed to stand still. Hg content in the natural gas liquid at the time soon after the standing was 344 ppb, and after 19 hours of standing was 61 ppb. It was supposed that though the reaction of $H_2S$ and Hg to form insoluble HgS may be rapid, the precipitation of the HgS takes a very long time. It is a vital disadvantage for the utilization of $H_2S$ for removal of mercury in a liquid hydrocarbon industriality.

Example 5–11

Similar experiments to that of Example 4 were conducted and mercury contents of the liquid hydrocarbon layers were measured, except that MM'S and adsorbents used were those mentioned in Table 1. The results are shown in Table 1.

TABLE 1

| Example | MM'S | Adsorbent | Hg Content (ppb) |
|---|---|---|---|
| 5 | $Na_2S$ | Cu Sulfide | 1 |
| 6 | $Na_2S$ | W Sulfide | 5 |
| 7 | $Na_2S$ | V Sulfide | 7 |
| 8 | NaHS | Mo Sulfide | 1 |
| 9 | $K_2S$ | Mo Sulfide | 1 |
| 10 | $(NH_4)2^S$ | Mo Sulfide | 2 |
| 11 | $(NH_4)2^S$ | Cu Sulfide | 4 |

Remarks: MM'S were used as 5 wt. % aqueous solution. Adsorbents contained 7 wt. % of metal and were supported on $\gamma$-alumina.

Comparative Example 2

To an adsorption apparatus packed with 1 gram of the same adsorbent composed of Mo-sulfide/$\gamma$-$Al_2O_3$ as used in Example 4, a natural gas liquid produced in Indonesia containing 350 ppb of mercury (as total Hg) was charged at a rate of 300 ml/hr.

The content of mercury in the effluent liquid was 4 ppb after 1 hour but went beyond 100 ppb after 5 hours. The result indicates a remarkably small adsorbing capacity for ionized mercury and ionizable mercury compounds. When a liquid hydrocarbon containing elemental mercury only was treated under the same condition, the mercury detected after 50 hours was negligible.

Example 12

A model liquid was prepared by dissolving in naphtha 200 ppb of elemental mercury and 200 ppb (as Hg) of mercury chloride. 100 ml of the model liquid was added to 100 ml of 5 wt.% aqueous solution of $Na_2S_4$, and was shaken with a shaking apparatus. After 10 minutes of shaking, the liquid hydrocarbon phase and water phase were separated, and mercury content in the liquid hydrocarbon phase was measured. The mercury content was reduced to 2 ppb.

Example 13

A model liquid was prepared by dissolving in naphtha 200 ppb of elemental mercury, 200 ppb (as Hg) of mercury chloride and 200 ppb (as Hg) of diethylmercury. 100 ml of the model liquid was added to 100 ml of 5 wt.% aqueous solution of $Na_2S_4$, and was shaken with a shaking apparatus. After 10 minutes of shaking, liquid hydrocarbon phase and water phase were separated, and mercury content in the liquid hydrocarbon phase was measured. The mercury content in the liquid hydrocarbon phase was 210 ppb and the most of which were organic mercury compound.

Then, to the liquid hydrocarbon phase was added 0.5 wt.% of an adsorbent composed of Mo sulfide/$\gamma$-$Al_2O_3$ containing 7 wt.% of molybdenum, and they were shaken for 60 minutes. After separating the adsorbent by filtration, mercury content in the liquid hydrocarbon phase was measured. The mercury content was 6 ppb.

As is noticeable from the above results, it is possible to remove simultaneously ionized mercury, ionizable mercury compounds and elemental mercury in a hydrocarbon by the treatment with an aqueous polysulfide solution. However, since the aqueous polysulfide solution is unable to remove organic mercury compounds, it is necessary to combine the treatment with aqueous polysulfide solution and the treatment with adsorbent against a liquid hydrocarbon containing ionized mercury, ionizable mercury, elemental mercury and organic mercury compounds.

Example 14

A model liquid was prepared by dissolving in naphtha 290 ppb of elemental mercury and 270 ppb (as Hg) of mercury chloride. 100 ml of the model liquid was added to 100 ml of 5 wt.% aqueous solution of $K_2S_{3.4}$, and was shaken with a shaking apparatus. After 15 minutes of shaking, liquid hydrocarbon phase and water phase were separated, and mercury content in the liquid hydrocarbon phase was measured. The mercury content was reduced to 4 ppb.

Example 15

A model liquid was prepared by dissolving in naphtha 280 ppb of elemental mercury and 280 ppb (as Hg) of mercury chloride. 100 ml of the model liquid was added to 100 ml of 5 wt.% (as sulfur) aqueous solution of $(NH_4)_2S_{3.4}$, and was shaken with a shaking apparatus. After 30 minutes of shaking, liquid hydrocarbon phase and water phase were separated, and mercury content in the liquid hydrocarbon phase was measured. The mercury content was reduced to 7 ppb.

Example 16

A model liquid was prepared by dissolving elemental mercury in naphtha to make Hg content in it to 520 ppb, and the liquid was employed as a raw material.

100 ml of the model liquid containing 520 ppb of elemental mercury were added to 100 ml of 5 wt.% aqueous solution of Na2S4, and the mixture was shaken with a shaking apparatus. Almost 100% of the elemental mercury was removed in 5 minutes.

When 100 ml of 1 wt.% aqueous solution of $Na_2S_4$ was used instead of 5 wt.% aqueous solution of $Na_2S_4$, almost 100% of the elemental mercury was removed in 20 minutes.

We claim:

1. A process for removal of mercury from a liquid hydrocarbon containing mercury comprising a combination of the following two steps a and b: a. contacting the liquid hydrocarbon with an aqueous solution of a sulfur compound represented by a general formula $MM'S_x$, wherein M is selected from a group consisting of alkali metal and ammonium radical, M' is selected from a group consisting of alkali metal, ammonium radical and hydrogen and x is a number of at least 1; and b. contacting the liquid hydrocarbon with an adsorbent comprising a heavy metal sulfide.

2. A process for removal of mercury from, a liquid hydrocarbon containing mercury according to claim 1, wherein the contact of the liquid hydrocarbon with the adsorbent is carried out after the contact of the liquid hydrocarbon with the aqueous solution of a sulfur compound.

3. A process for removal of mercury from a liquid hydrocarbon containing mercury comprising following successive three steps a, b and c:

a. contacting the liquid hydrocarbon with an aqueous solution of a sulfur compound represented by a general formula $MM'S_x$, wherein M is selected from a group consisting of alkali metal and ammonium radical, M' is selected from a group consisting of alkali metal, ammonium radical and hydrogen and x is a number of at least 1;

b. separating the aqueous solution of a sulfur compound from the liquid hydrocarbon; then c. contacting the liquid hydrocarbon with an adsorbent comprising a heavy metal sulfide.

4. A process for removal of mercury from a liquid hydrocarbon containing mercury according to claim 1 or 3, wherein the liquid hydrocarbon is a natural gas liquid.

5. A process for removal of mercury from a liquid hydrocarbon containing mercury according to claim 1, or 3, wherein the concentration of the sulfur compound represented by the general formula $MM'S_x$ in the aqueous solution is at least 1.0 weight.%.

6. A process for removal of mercury from a liquid hydrocarbon containing mercury according to claim 1, or 3, wherein the sulfur compound is a sulfide with $x=1$ in the general formula $MM'S_x$.

7. A process for removal of mercury from a liquid hydrocarbon containing mercury according to claim 6, wherein the sulfide $Na_2S$, NaHS, $K_2S$, KHS, $(NH_4)_2S$, $(NH_4)HS$ or mixtures thereof.

8. A process for removal of mercury from a liquid hydrocarbon containing mercury according to claim 1 or 3, wherein the sulfur compound is a polysulfide with $x=2$ or more in the general formula $MM'S_x$.

9. A process for removal of mercury from a liquid hydrocarbon containing mercury according to claim 8, wherein the polysulfide is sodium polysulfide, potassium, polysulfide, ammonium polysulfide or mixtures thereof.

10. A process for removal of mercury from a liquid hydrocarbon containing mercury according to claim 1, 2, 3, or 4, wherein the adsorbent is a heavy metal sulfide supported on a carrier.

11. A process for removal of mercury from a liquid hydrocarbon containing mercury according to claim 10, wherein the heavy metal sulfide is molybdenum sulfide, tungsten sulfide, vanadium sulfide, copper sulfide or mixtures thereof.

* * * * *

UNITED STATES PATENT AND TRADEMARK OFFICE

CERTIFICATE OF CORRECTION

PATENT NO. : 5,037,552

DATED : August 6, 1991

INVENTOR(S) : FURUTA et al.

It is certified that error appears in the above-identified patent and that said Letters Patent is hereby corrected as shown below: On the title page:

Item [73] Assignee: change "JCG Corporation" to --JGC Corporation--;

Abstract right column, line 11 change "preesent" to --present--;

Column 1, line 64, change "at 1 least" to --at least--;

Column 4, line 27, change "5.400m2/g" to --5-400 $m^2/g$--;

Column 4, line 28, change "100.250" to --100-250--;

Column 4, line 43, change "0.1 2" to --0.1-2--;

Column 4, line 47, change "$5(NH_4)_2O.12WO3.5H_2O$" to --$5(NH_4)_2O.12WO_3.5H_2O$--;

Column 6, line 58, change "$(NH_4)2^S$" to --$(NH_4)_2S$--;

Column 6, line 59, change "$(NH_4)2^S$" to --$(NH_4)_2S$--;

UNITED STATES PATENT AND TRADEMARK OFFICE

CERTIFICATE OF CORRECTION

PATENT NO. : 5,037,552

DATED : August 6, 1991

INVENTOR(S) : Furuta et al

It is certified that error appears in the above-indentified patent and that said Letters Patent is hereby corrected as shown below:

Column 8, line 29, claim 2, change "from," to --from --.

Column 8, line 65, change "sulfide" to --sulfide is --.

Column 9, lines 5 and 6, change "potassium," to --potassium--.

Signed and Sealed this

Thirteenth Day of July, 1993

*Attest:*

Michael K. Kirk

MICHAEL K. KIRK

*Attesting Officer*

*Acting Commissioner of Patents and Trademarks*

UNITED STATES PATENT AND TRADEMARK OFFICE

CERTIFICATE OF CORRECTION

PATENT NO. : 5,037,552

DATED : August 6, 1991

INVENTOR(S) : FURUTA et al.

It is certified that error appears in the above-identified patent and that said Letters Patent is hereby corrected as shown below:

Column 4, line 47, change "$5(NH_4)_2O.12WO3.5H_2O$" to --$5(NH_4)_2O.12WO_3.5H_2O$--;

Column 7, line 66, change "$(NH_4)_2S_{3.4}$" to --$(NH_4)_2S_{3-4}$--;

Signed and Sealed this

Twenty-first Day of September, 1993

Bruce Lehman

*Attest:*

BRUCE LEHMAN

*Attesting Officer*

*Commissioner of Patents and Trademarks*